US005678117A

United States Patent [19]

Alzner et al.

[11] Patent Number: 5,678,117

[45] Date of Patent: Oct. 14, 1997

[54] FILM PROCESSOR FOR X-RAY FILM

[75] Inventors: Edgar Alzner, Garden City; Dennis Allmer, Patchoque; Frank Bader, Port Jefferson, all of N.Y.

[73] Assignee: Air Techniques, Inc., Hicksville, N.Y.

[21] Appl. No.: 705,961

[22] Filed: Aug. 30, 1996

[51] Int. Cl.[6] ..... G03D 3/02

[52] U.S. Cl. ..... 396/612; 396/631

[58] Field of Search ..... 396/571, 572, 396/612, 617, 622, 624, 626, 630, 631

[56] References Cited

U.S. PATENT DOCUMENTS

| | | | |
|---|---|---|---|
| 3,747,499 | 7/1973 | Foster | 396/576 |
| 3,882,525 | 5/1975 | Zwettler | 396/622 |
| 4,125,852 | 11/1978 | Brooks | 396/622 |
| 4,432,475 | 2/1984 | Lee et al. | 222/509 |
| 4,779,636 | 10/1988 | Crowe | 137/15 |
| 5,241,339 | 8/1993 | Marany | 396/622 |
| 5,287,123 | 2/1994 | Medin et al. | 346/140 R |
| 5,368,653 | 11/1994 | Russell | 134/24 |

*Primary Examiner*—D. Rutledge

*Attorney, Agent, or Firm*—Louis E. Marn

[57] ABSTRACT

There is disclosed an automatic X-ray film processor assembly comprised of a gear drive assembly for the film transport unit including continuously operated lower and upper film lifters operating at different rotational speeds for passing film more rapidly through processing units. Additionally, there is provided an improved drying assembly including gear train in driving interrelationship with the gear drive assembly for the film transport as well as a fan unit providing improved aero-thermodynamics for drying film chips and additionally reducing film transit times. Additionally, there is provided a valved water drain system and a closeable door access means to more easily facilitate wash water draining and refilling for improved film processing.

10 Claims, 4 Drawing Sheets

FILM PROCESSOR FOR X-RAY FILM

BACKGROUND OF THE INVENTION

1. Field of the Invention

This invention relates to a film processing assembly, and more particularly, to an improved film assembly for a film processor for automatically processing X-ray film chips at reduced processing times.

2. Description of the Prior Art

There are many instances when the frequent processing of batches of exposed X-ray film chips is necessary, one of these being in a dentist's office. Since the time of the dentist and his assisting nurse is taken up with caring for the patient, it is not only inconvenient, but sometimes impossible for them to attend to the development of such film chips. There is, thus, a need for apparatus to automatically develop batches of X-ray film chips in a dentist office as quickly as possible and with a minimum of supervision on the part of the dentist or his assisting nurse.

In U.S. Pat. No. 3,882,525 to Zwettler, there is disclosed a processor for developing batches of dental X-ray film chips including a film transport unit comprised of a pair of laterally-disposed, vertically-spaced, parallel walls forming a continuously curved channel with three loops. The downwardly-extending curved portions of the loops, respectively, extend into tanks in the development compartment of the processor. A lower lifter is mounted to rotate in each downwardly-extending curved portion of the continuous channel, and an upper lifter is mounted to rotate in each upwardly-extending curved portion of the continuous channel. The inside surfaces of the pair of walls are provided with opposing V-grooves which form a path for engaging the opposite edges of a vertically-disposed film chip. The film chip is permitted to drop by gravity along the downwardly-extending portions of its path and is lifted by the lower and upper rotating lifters along the upwardly extending portions of its path.

In U.S. Pat. No. 4,760,417, also to Zwettler, there is disclosed an improved portable roll film processor for automatically processing roll film wherein a removable film drive module is provided for moving the film through tanks containing chemical processing liquids. The film drive module defines an essentially serpentine path for the film including successive U-shaped sections depending from a common frame member. Each of the U-shaped sections extends into a different tank and includes a down path leg for carrying the film into the tank and an up path leg for carrying the film out of the tank. All moving parts except those sub-assemblies contacting the film in moving it are located above the liquids to minimize maintenance problems.

While such film processors effectively developed X-ray film chips, the film drive assemblies resulted in extended processing times as well as varying processing conditions. Generally, the rate of rotation of the upper arms is at a fixed relationship to that of the lower arms. The previous lower arm pair embodiments restricted these upper and lower arms to a certain "slow speed" for efficacious processing. This results in a loss of time between the time the film exits the liquid in one tank and enters the liquid in the next tank under the influence of the "slow" upper arms. A "slow" lower arm pair results in a slow upper arm motion. Having instead a "fast" single lower arm, which provides equivalent immersion time for processing, will result in a "fast" upper arm thereby reducing to approximately half the crossover transit time. The Assignee hereof is the Assigner of U.S. Pat. No. 5,241,339 for an Improved Film Processor For X-ray Film which was directed towards an apparatus which overcame some of the problems discussed heretofore. Specifically, Applicant in U.S. Pat. No. 5,241,339 achieved the objectives for the automatic x-ray film processor with an assembly comprised of a drive assembly which included intermittently operated lifters for passing the film chips from each tank through succeeding processing units, thereby ensuring more uniform processing time as well as permitting facile changes in processing times, and additionally provided for a film chip withdrawal assembly at a point intermediate the film processing as well as a channel for readmitting any such intermediate processed film chip into the processor for completion of film processing.

While such techniques have been effective in the facile development of dental X-rays, there is the requirement to reduce processing times, particularly by reducing cross-over times between film chip immersion; the facile ability to change processing solutions, and in particular wash water; and improved driving assemblies to reduce preventative maintenance requirements.

OBJECTS OF THE PRESENT INVENTION

An object of the present invention is to provide a film drive assembly for an automatic film processor permitting of faster processing time.

Another object of the present invention is to provide a film drive assembly for an automatic film processor permitting of more uniform processing.

Yet another object of the present invention is to provide a film drive assembly for an automatic film processor permitting of facile changes in processing conditions.

Still another object of the present invention is to provide a film drive assembly for an automatic film processor permitting of more rapid transport between processing steps.

A still further object of the present invention is to provide for a film drive assembly which reduces the amount of time that the film spends in the non-immersion portion of the processing.

A still further object of the present invention is to provide for a drain element to permit the draining of used wash water and an access door means for refilling fresh wash water and topping off chemistry more easily and more often, in particular without removing covers and other portions of the processor.

A still further object of the present invention is to provide a film drive assembly for an automatic film processor in which all the transport functions are performed by a single drive motor.

SUMMARY OF THE INVENTION

These and other objects of the present invention are achieved by an automatic X-ray film processor assembly comprised of a gear drive assembly for the film transport unit including continuously operated lower and upper film lifters operating at different rotational speeds for passing film more rapidly between processing units. Additionally, there is provided an improved drying assembly including gear train in driving interrelationship with the gear drive assembly for the film transport as well as a fan unit providing improved aero-thermodynamics for drying film chips. Additionally, there is provided a wash tank drain system to make more facile replacement of wash water and there is provided an access door for re-filling such wash tank with water and topping of chemistry without the need to remove or disassemble portions of the processor.

Additionally, there is provided an improved chemistry heating system to provide highly uniform and constant temperature conditions for improved processing.

BRIEF DESCRIPTION OF THE DRAWINGS

Further objects and advantages of the present invention will become apparent from the following detailed description when taken with the accompanying drawings wherein.

DETAILED DESCRIPTION OF THE PRESENT INVENTION

Figure 1:
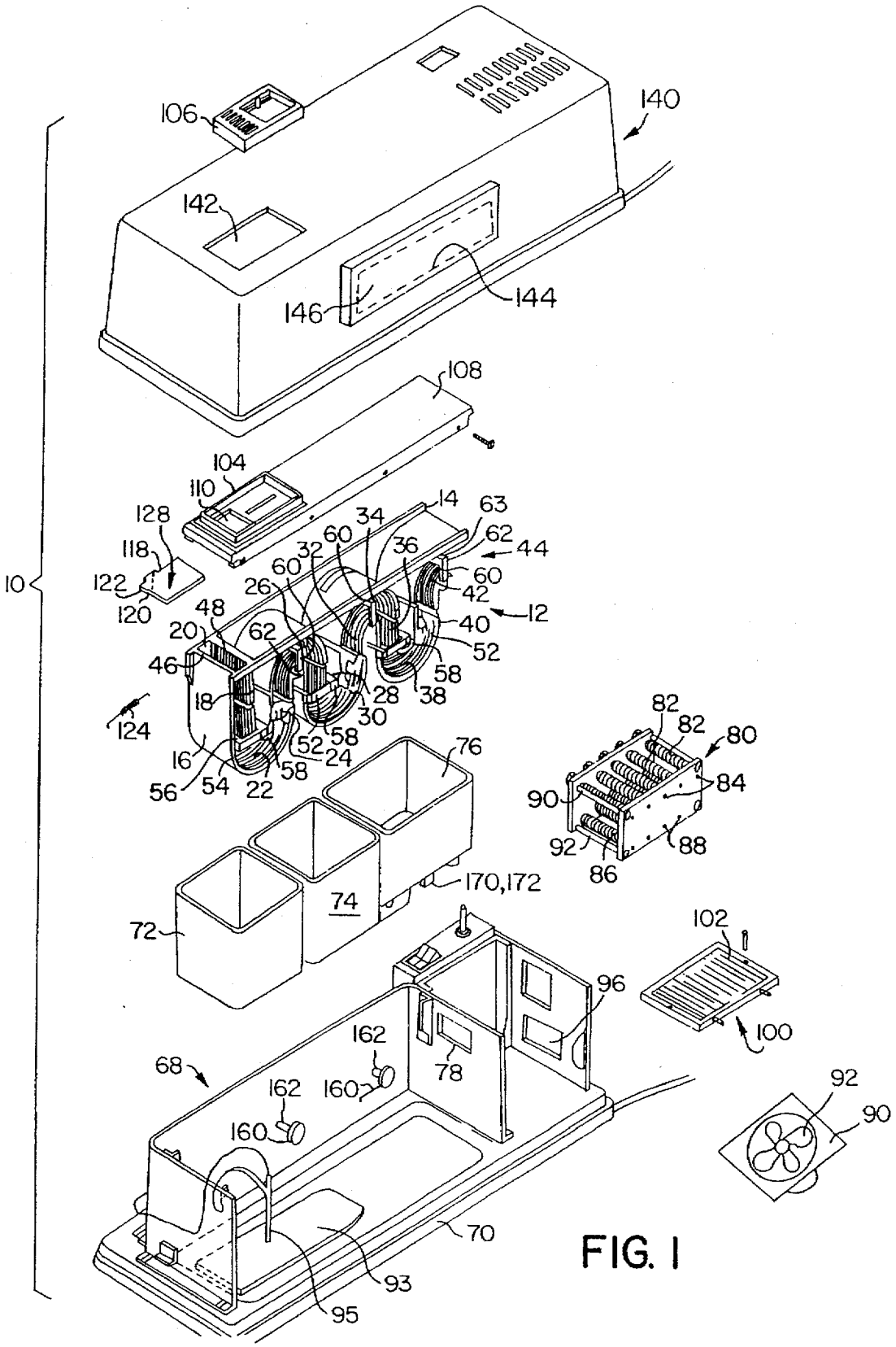
FIG. 1 is an exploded view of the components forming the film processor of the present invention.

Prior to the detailed description of the present invention, reference will be had to FIG. 1 which is an exploded view of an X-ray film processor of the type disclosed in Applicant's U.S. Pat. No. 5,241,339. Applicant specifically incorporates the aforesaid U.S. patent by reference herein and will address FIG. 1 in order to provide a setting and background for the detailed description of the present inventions detailed herein.

Figure 2:
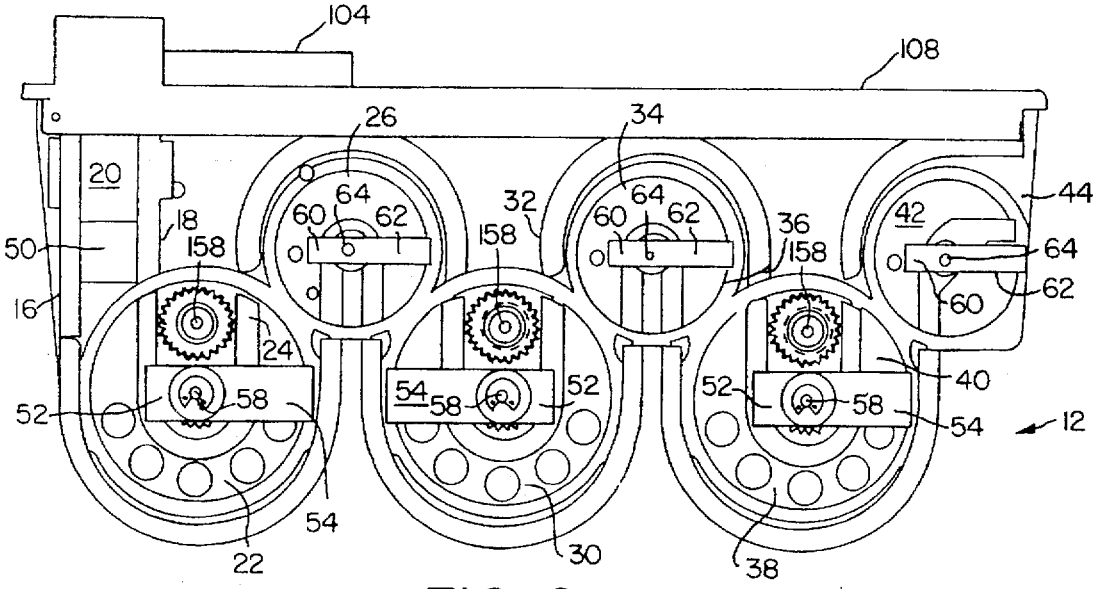
FIG. 2 is a schematic front elevational view of the film transport lifter arrangement of the present invention.

Referring now more particularly to FIG. 1, component parts of the film chip processor, generally indicated as 10, include a film chip transport unit, generally indicated as 12, comprised of a molding having a vertical rear wall 14 with laterally-extending spaced, parallel, outer and inner curved walls 16 and 18, respectively, forming a channel with three downwardly-extending open loop portions. The channel formed by the outer and inner walls 16 and 18 comprises a vertical entrance passage 20 leading down into a first lower semicircular portion 22 which curves up into a vertical portion 24 leading into a first upper semicircular portion 26. The upper semicircular portion 26 then curves down into a vertical portion 28 leading down into a second lower semicircular portion 30 which curves up into a vertical portion 32 leading into a second upper semicircular portion 34. The second upper semicircular portion 34 then curves down into a vertical portion 36 leading into a third lower semicircular portion 38 which curves up into a vertical portion 40 leading into an upper quarter circular portion 42 that leads into a horizontal exit passage 44, as more clearly illustrated in FIG. 2.

The opposing lateral surfaces of the channel formed by the outer and inner curved walls 16 and 18 each have ten V-grooves 46 and 48, respectively, extending along the length thereof as more fully hereinafter discussed. Each pair of opposing V-grooves 46 and 48 serves to engage opposite edges of a small flexible vertically disposed film chip 50 to be advanced through the film chip transport unit 12.

Three lower lifters 52, each having a single radially-extending arm member 54 including a laterally-extending arm portion 56, are mounted to rotate about the axes of their respective shafts 58 disposed at the center of each of the lower semicircular portions 22, 30 and 38 of each channel. Three upper lifters 60, each having a radially-extending arm member 62, including a laterally-extending arm portion 63, are respectively mounted to rotate about the axes of their respective shafts 64 disposed at the center of each of the upper semicircular portions 26, 34 and the quarter circular portion 42 of the last section of the channel. The lower and upper lifters 52 and 60 cooperate to raise the film chips 50 along the rising portions of the V-grooved paths formed by the channel.

As more fully hereinafter described, a gear train, generally indicated as 66, is provided on the vertical rear wall 14 of the transport unit for rotating the lower lifters 52 and the upper lifters 60 referring to FIG. 3. Since the lifters 52 and 60 have only one arm 56 and 67, respectively, and a gear train 66, speed change of 66/36, faster cross-over times are achieved thereby reducing overall (drop to drop) processing times of film chips being processed.

When the transport unit 12 is lowered into an inner housing, generally indicated as 68, referring again to FIG. 1, which is mounted on a base 70, the lower semicircular portions 22 and 30 and 38 thereof, respectively, fit into the three tanks 72, 74 and 76 and the exit passage 44 of the channel is aligned with the entrance opening 78 into the drying compartment on the right end of the inner housing 68. A roller drive unit, generally indicate as 80, located in the drying compartment includes five transversely disposed upper rollers 82 rotatable on respective shafts 84 and five transversely disposed lower rollers 86 rotatable on respective shafts 88 driven by a gear train, generally indicated as 89 in geared relationship to gear 160 as more fully hereinafter described. The vertically-spaced upper and lower rollers 82 and 86 are formed with ten V-grooves 90 and 92, respectively.

A heating pad 93, referring to FIG. 1, is positioned within the base 70 beneath tanks 72 and 74 permitting uniform heating of processing chemicals to facilitate processing and thermistor 95 is positioned on the side of the base so as to be insertable into the processing chemical to monitor its temperature for improved temperature control for more uniform processing.

Mounted on the base of the drying compartment below the roller drive unit 80 is a fan 92, referring more particularly to FIGS. 6 and 7 with a shroud member 94 positioned thereabout. A heater device 100 having a plurality of heating wires 102 extending there across is positioned above the fan 92. Thus, as the film chips 50 are advanced through the roller drive unit 80, they are dried by the hot air blown there past by the fan 92. An inlet port 96 is provided in an end wall of the housing 68 to provide more effective fluid flow.

In order to load the film chips 50 into the processor, a rectangularly-shaped receiver 104 for a magazine 106 is provided on the left end of a top member 108 of the transport unit 12. The receiver 104 has a rectangular opening 110 aligned with the vertical entrance passage 20 into the channel. The magazine 106 includes a top plate 112 provided with ten parallel slots 114 which are located above the opening 110 in the receiver 104 in alignment with the respective pairs of V-grooves 46 and 48 in the opposing walls of the channel. A gate member 118 located to slide in recesses on the bottom of the magazine 106 is initially moved to a 75% open right-hand position to cock the film release mechanism and, until released, to prevent the film chips 50 from dropping during loading the magazine.

The gate member 118 is disposed to slide in a recess provided on the underside of the receiver 104. The backside of the gate member 118 has a vertical extension 120 provided with a pin 122. A spring 124 normally holds the gate member 118 toward the left to close the entrance passage 20. With the magazine loaded with the film chips 50, the gate member 118 is caused to move to its right-hand position while the pin 128 is being slowly moved manually to the right in slot 130 as more fully described in the aforementioned Zwettler et al. U.S. Pat. No. 4,125,852. With the gate member 118 forced to its extreme right position, the opening 110 is cleared so that film chips 50 stored in the slots 114 of the magazine 116 drop down into the channel. Successive batches of the standard size film chips 50 drop down into the entrance passage 20 of the channel and thence into the first tank 72 from which they are successively transported by the lower and upper lifters 52 and 60 to the tanks 74 and 76, and thence into the roller drive unit 80 in the dryer.

The film chip processor 10 is provided with a cover, generally indicated as 140, including a rectangularly-shaped opening 142 for positioning over the receiver 104 formed on the top member 108 and a rectangularly-shaped opening 144 in a sidewall for positioning an access door member 146.

Figure 3:
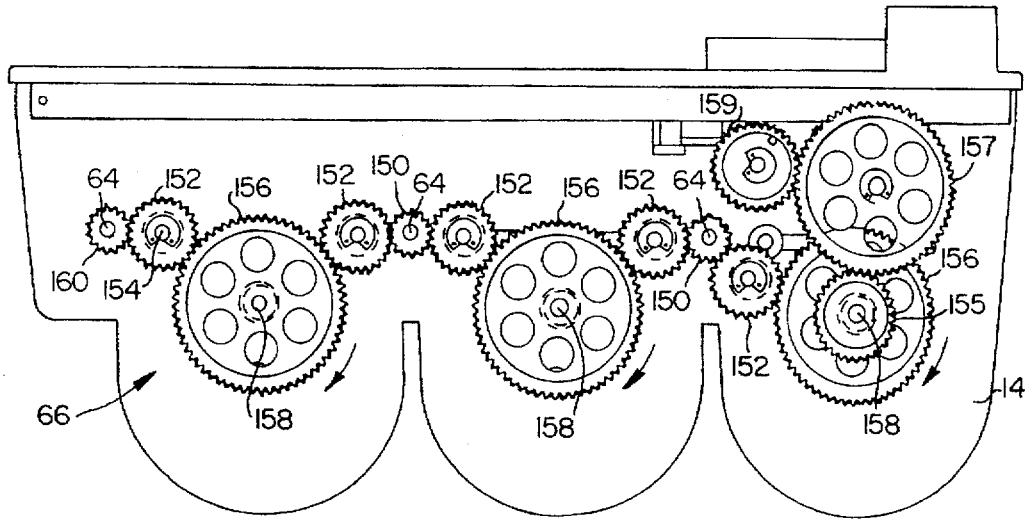
FIG. 3 is a schematic rear elevational view of the gearing arrangement of the present invention.
Figure 5:
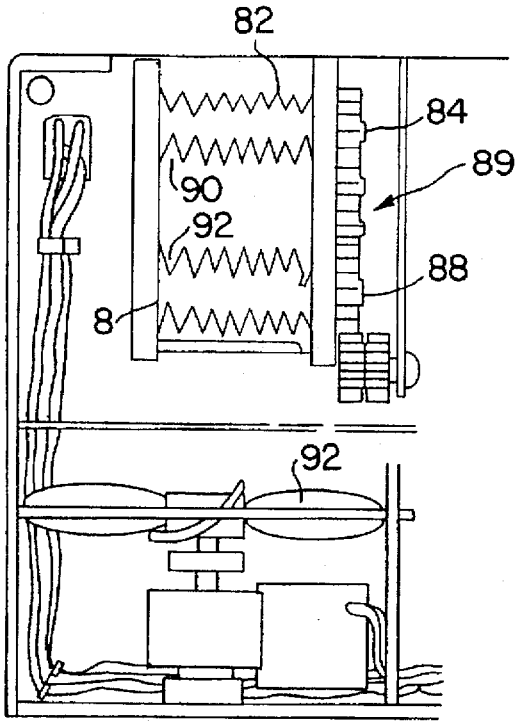
FIG. 5 is a partial and elevational view taken along the lines V—V of FIG. 4.
Figure 4:
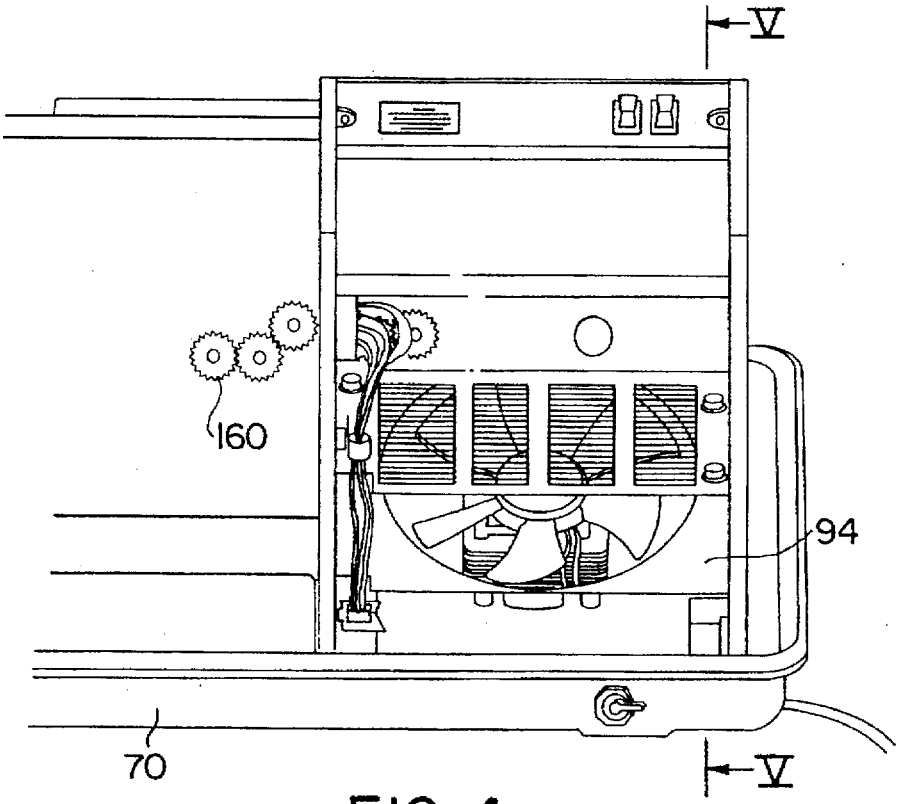
FIG. 4 is a partial schematic isometric view of the present invention.

Referring now to FIG. 3, there is illustrated the driving gear train 66 comprised of gears 150 affixed to shafts 64 for rotating the upper lifters 60, intermediate idler gears 152 mounted to shafts 154 and gears 156 mounted to shafts 158. The gears 150, 152 and 156 are driven by drive motor gear pinion 160 mounted in a shaft 162 in meshed interrelationship with the middle gear 156 mounted on shaft 58 proximate the tank 74.

Gear 155 is mounted on the same shaft as gear 158 proximate tank 72. Gear 157 meshes with gear 155 and gear 159 providing a 2:1 gear reduction so that the gate member 118 is activated only half as often, to correspond to having only one transport arm 52 instead of two.

Figure 6:
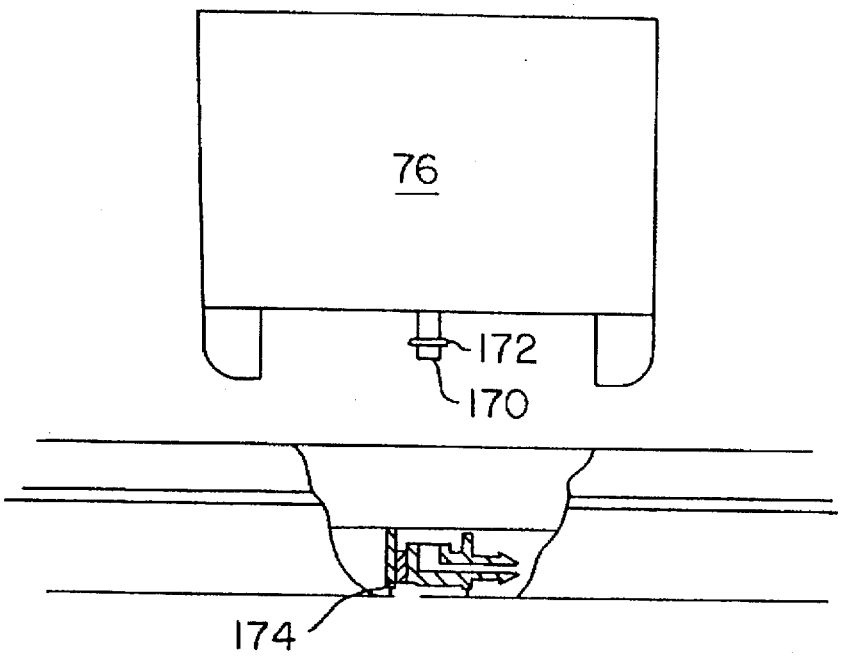
FIG. 6 is a partial enlarged cross-sectional view of the water solution vessel and related outlet conduit assembly.
Figure 7:
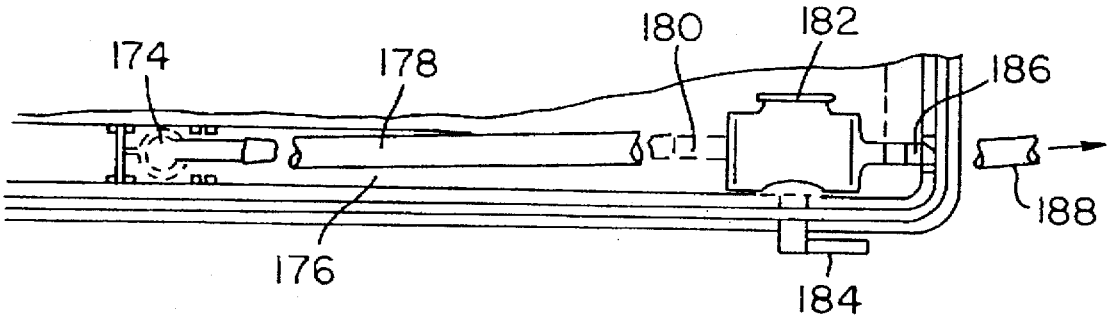
FIG. 7 is a partial top view of the inner housing illustrating the outlet conduit assembly.

Referring to FIGS. 1, 6 and 7, the water tank 76 is formed with a downwardly extending outlet conduit 170 including a gasket 172. The bottom 70 of the assembly 10 is provided with a connector assembly 174, disposed in a channel 176 of the bottom 70, in fluid communication by a conduit 178 with an inlet nipple 180 of a valve assembly 182 under the control of a lever 184. The valve assembly 182 is provided with an outlet nipple 186 in fluid flow communication with a conduit 188. Positioning the water tank 76 within the bottom 70 of the assembly 10, the outlet conduit 170 is received in fluid tight relationship within an orifice of the connector assembly 174 for permitting facile removal of a liquid from the tank 76 as more fully hereinafter described.

In operation, counterclockwise rotation of the drive gear 160 about the shaft 162 by motor drive assembly (not shown) effects rotation of the gears 156 as illustrated by the arrows in FIG. 3. Given the gearing ratios, as hereinbefore described, the upper lifters 60 are rotated at twice the rotational speeds of the lower lifters 52, and since the single arm film transport arms 54 rotate 11/6 times faster than did the previous pair of transport arms, there is a reduction of cross-over times through the upper circular portions 26, 34 and 44.

The present invention further refines the film processor to reduce overall film processing time by reducing the amount of time the film spends in the dryer portion of the process due to the improved aerodynamics of the dryer by the addition of the shroud, and improves the transportation functions by performing all transportation functions with a single drive motor to achieve cost and reliability benefits. Additionally, the film processor of the present invention permits the changing and replenishment of the wash water more easily for good quality film processing.

While the invention has been described in connection with an exemplary embodiment thereof, it will be understood that many modifications will be apparent to those of ordinary skill in the art; and that this application is intended to cover any adaptations or variations thereof. Therefore, it is manifestly intended that this invention be only limited by the claims and the equivalents thereof.

What is claimed is:

1. A processor for film chips comprising:

a development compartment;

a series of tanks in said development compartment;

a channel formed of a pair of laterally-extending, parallel spaced walls having lower curved portions extending down into and out of each of said tanks and upper curved portions extending from each tank to the succeeding tank;

a plurality of V-grooves formed on the opposing surfaces of said spaced walls, each V-groove on one wall associated with a V-groove on the opposite wall to form a pair of opposing V-grooves lying in the same vertical plane forming a transport path through the channel for a vertically-orientd film chip or film carrier;

a lower lifter member having only one arm member extending into said channel and mounted for rotation about an axis substantially at the center of each lower curved portion of the channel extending down into and out of each of said tanks;

an upper lifter member having only one member extending into said channel and mounted for rotation about an axis substantially at the center of each upper curved portion of the channel extending from each tank to a succeeding tank, each said upper lifter member timed to rotate with a lower lifter member so that when said arm member of said lower lifter member lifts film chips along a transport path out of a tank, said arm member of said upper lifter member continues to lift and transfer film chips into a succeeding stage of the processor;

gear means for continuously rotating said lower and upper lifter members at a rotational ratio speed of 1:2 and for coordinating film chip entry with position of lower lifter member of first tank of development compartment; and motor means for driving said gear means.

2. The film chip assembly as defined in claim 1 and further including a film drying chamber including a plurality of upper and lower rollers for moving said film chips therethrough and further including a fan assembly including fan blades driven by a motor for passing air through said film drying chamber, said fan assembly being positioned within a shroud within said film drying chamber.

3. The film chip assembly as defined in claim 2 and further including a heating means including a plurality of wires disposed between said fan and said roller in said film drying chamber.

4. The film chip assembly as defined in claim 2 wherein said rollers of said film drying means include gears driven by said motor means.

5. The film chip assembly as defined in claim 1 and further including a heating pad means positioned within said development compartment beneath said tank.

6. The film chip assembly as defined in claim 5 and further including a temperature sensing means positioned within a first tank of said development compartment for generating a signal of temperature level.

7. The film chip assembly as defined in claim 6 and further including an adjustable temperature control means for receiving said signal of temperature level to regulate heating pad power to maintain a uniform temperature.

8. A processor for film chips comprising:

a development compartment;

a series of tanks in said development compartment including a tank for wash water, said wash water tank including a nipple member;

a connector member disposed in said development compartment for receiving said nipple member of said wash water tank during positioning of said wash water tank in said development compartment;

a valve member having an outlet conduit; and a conduit member disposed in fluid flow relationship between said nipple member of said wash water tank and said tank member.

9. The processor for film chips as defined in claim 8 and further including a closeable access means for viewing and filling said tanks.

10. The processor for film chips as defined in claim 9 and further including a living hinge-type latch mechanism to provide facile opening and latching of said closeable access means.

* * * * *